US006527581B1

(12) United States Patent
Wang

(10) Patent No.: US 6,527,581 B1
(45) Date of Patent: Mar. 4, 2003

(54) NETWORK CONVERTER AND BASE APPLIED IN UNIVERSAL SERIAL BUS

(75) Inventor: Chun-Chieh Wang, Hsinchu (TW)

(73) Assignee: Accton Technology Corporation, Hsinchu (TW)

( * ) Notice: Subject to any disclaimer, the term of this patent is extended or adjusted under 35 U.S.C. 154(b) by 0 days.

(21) Appl. No.: 09/999,404

(22) Filed: Oct. 31, 2001

(51) Int. Cl.[7] ..... H01R 13/56

(52) U.S. Cl. ..... 439/445; 439/533; 439/929; 439/4; 439/460

(58) Field of Search ..... 439/445, 76.1, 439/533, 929, 502; 371/4, 684

(56) References Cited

U.S. PATENT DOCUMENTS 4,210,380 A * 7/1980 Brzostek ..... 439/456
5,030,902 A * 7/1991 Mattinger et al. ..... 320/2
6,363,697 B1 * 4/2002 Tseng et al. ..... 439/533

* cited by examiner

*Primary Examiner*—Renee Luebke
*Assistant Examiner*—Briggitte Hammond
(74) *Attorney, Agent, or Firm*—Thomas, Kayden, Horstemeyer & Risley

(57) ABSTRACT

The present invention discloses a network converter and its base applied in USB. The USB network converter of the present invention comprises a converting body and a base. The converting body includes a PCB whose one end has a network port and the other end connects to a USB cable. The base has a socket hole, the positive side of the base is for containing the converting body, and the reverse side is used to fasten the USB cable and fix the USB plug in the socket hole.

7 Claims, 6 Drawing Sheets

NETWORK CONVERTER AND BASE APPLIED IN UNIVERSAL SERIAL BUS

BACKGROUND OF THE INVENTION

1. Field of the Invention

The present invention relates to a network converter applied in a universal series bus (USB), particularly to an expandable network converter and its base applied in a universal series bus.

2. Description of Related Art

Almost all prior converters of input devices focus on serial ports or PS/2 ports. However, when input devices having USB interfaces become more popular, many converters for USB interfaces appear in the market. One advantage of using USB interfaces is the plug-and-play function, which restarts a connection by automatically researching after a connection is broken, and it is not necessary to create an additional signal-maintained circuit for makers and thereby saving the manufacturing cost.

Besides, USB converters can act as interfaces of personal computers and networks (such as Ethernet, HomePNA, wireless local network, etc.) and replace traditional network cards. Prior USB network converters include three types shown in FIGS. 1(*a*) to 1(*d*). In FIG. 1(*a*), a USB network converter 10 includes a housing 11, an A-typed USB cable 12, and a network port (not shown) on the housing 11 opposite to the A-typed USB cable 12. The A-typed USB cable 12 can plug into a USB port 14 of a personal computer 13, and the network port connects to a hub 16 through a network cable 15, as shown in FIG. 1(*b*). A printed circuit board (PCB; not shown) is inside the housing 11 of the USB network converter 10 for transferring USB signals and network signals. FIG. 1(*c*) is a solid diagram of a PCB 18 of another USB network converter. The largest difference from the USB network converter 10 shown in FIG. 1(*a*) is that the USB network converter in FIG. 1(*c*) directly mounts an A-typed USB plug 170 on the PCB 18 inside the housing, and omits the A-typed USB cable 12. Similarly, the USB network converter in FIG. 1(*c*) connects to the USB port 14 of a personal computer 13 by directly plugging the A-typed USB plug 170, and using a network cable 15 to connect the network port 19 into a hub 16. FIG. 1(*d*) is a solid diagram of a PCB 18' of another USB network converter. The largest difference from the USB network converter in FIG. 1(*c*) is that the USB network converter mounts a B-typed USB plug 171 on a PCB 18' in the housing. The appearance of the B-typed USB plug 171 is larger than the A-typed USB plug, and the above two kinds are the most popular forms in the market. The using method of the USB network converter in FIG. 1(*d*) is connected to the USB port 14 of a personal computer 13 through a B-typed to A-typed USB cable, and another end of the USB network converter uses the network port to connect to a hub 16 through the network cable 15.

As mentioned above, due to the three kinds of USB network converters in the market, it is necessary to prepare three different kinds of manufacturing molds and three different kinds of PCBs simultaneously for product makers. However, the cost is high, and the assembly process and the product management will be complicated. Therefore, how to effectively simplify these three kinds of USB network converters into a uniform one so as to reduce the manufacturing cost is an important issue.

SUMMARY OF THE INVENTION

A main object of the present invention is to provide an expandable and modulable USB network converter. The USB network converter of the present invention can achieve the functions of three prior USB network converters.

To obtain the above purpose, the USB network converter of the present invention comprises a converting body and a base. The converting body includes a PCB whose one end has a network port and the other end connects to a USB cable. The base has a socket hole, the positive side of the base is for containing the converting body, and the reverse side is used to fasten the USB cable and fix the USB plug in the socket hole.

The USB network converter of the present invention has the following advantages:

1. By a proper usage, the USB network converter of the present invention can achieve the functions of the three prior USB network converters.
2. The maker only needs one mold and to design one PCB to accomplish the USB network converter of the present invention, therefore the cost is low.
3. It is easy to assembly, occupies only little spaces, and can adjust output formats according to customer's demands.

BRIEF DESCRIPTION OF THE DRAWINGS

The present invention will be described according to the appended drawings in which.

PREFERRED EMBODIMENT OF THE PRESENT INVENTION

Figure 1A:
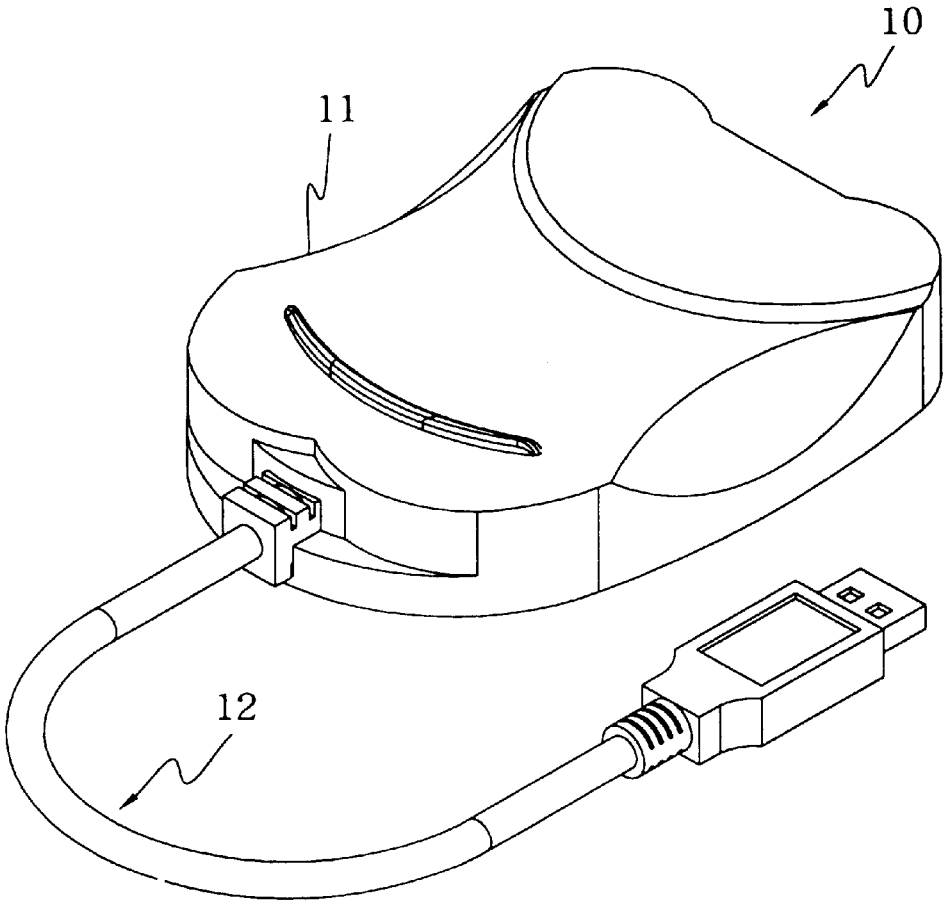
FIG. 1(a) (Prior Art)
FIGS. 1(*a*) to 1(*d*) show the solid diagrams of prior USB network converters.
Figure 1C:
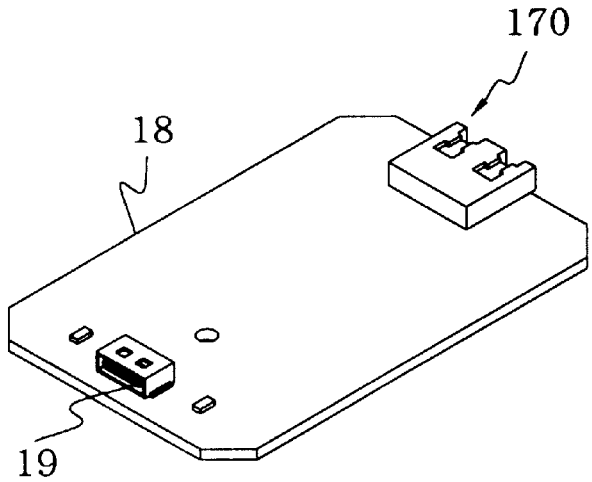
FIG. 1(c) (Prior Art)
Figure 1B:
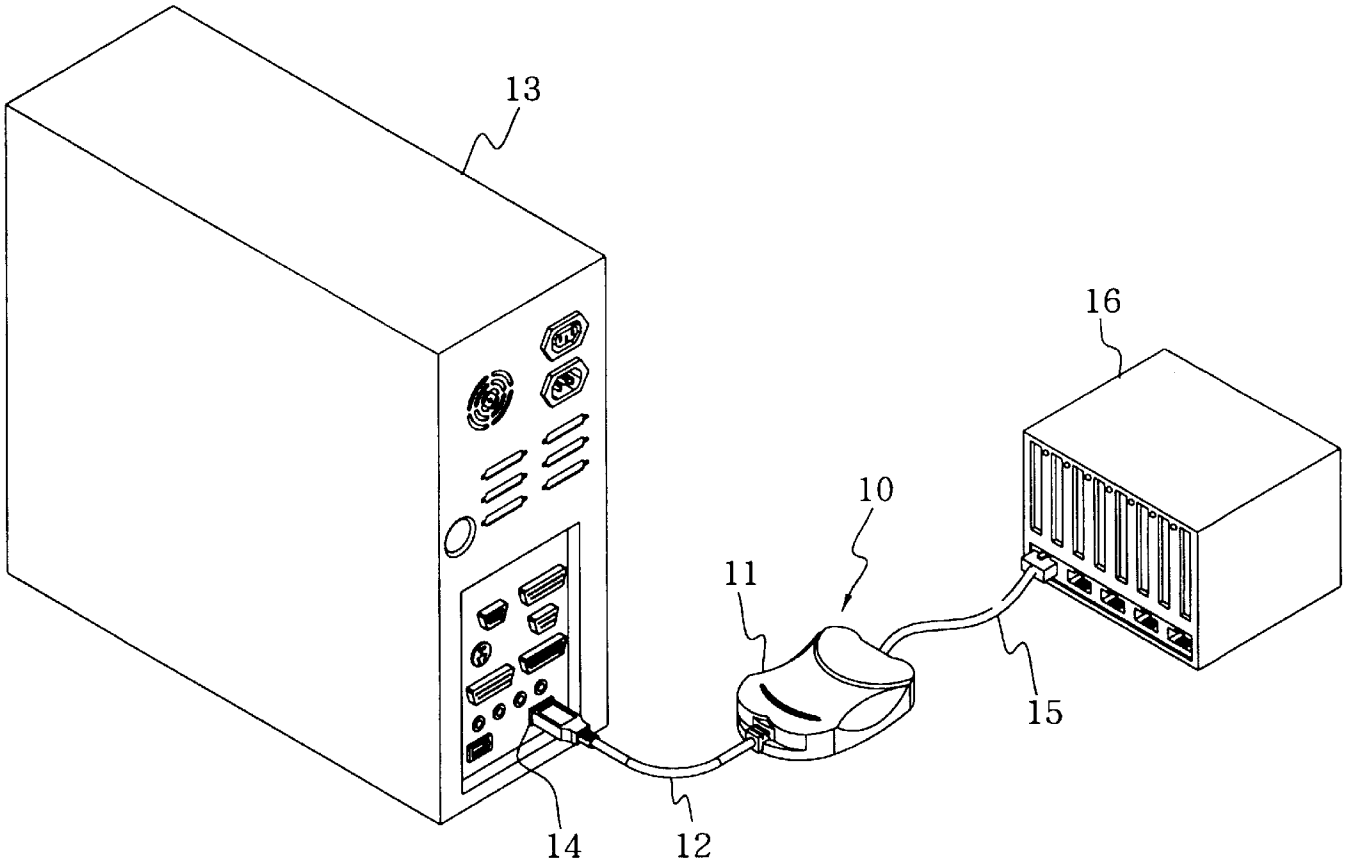
FIG. 1(b) (Prior Art)
Figure 1D:
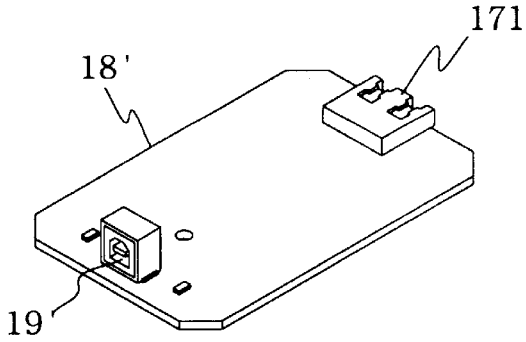
FIG. 1(d) (Prior Art)
Figure 2A:
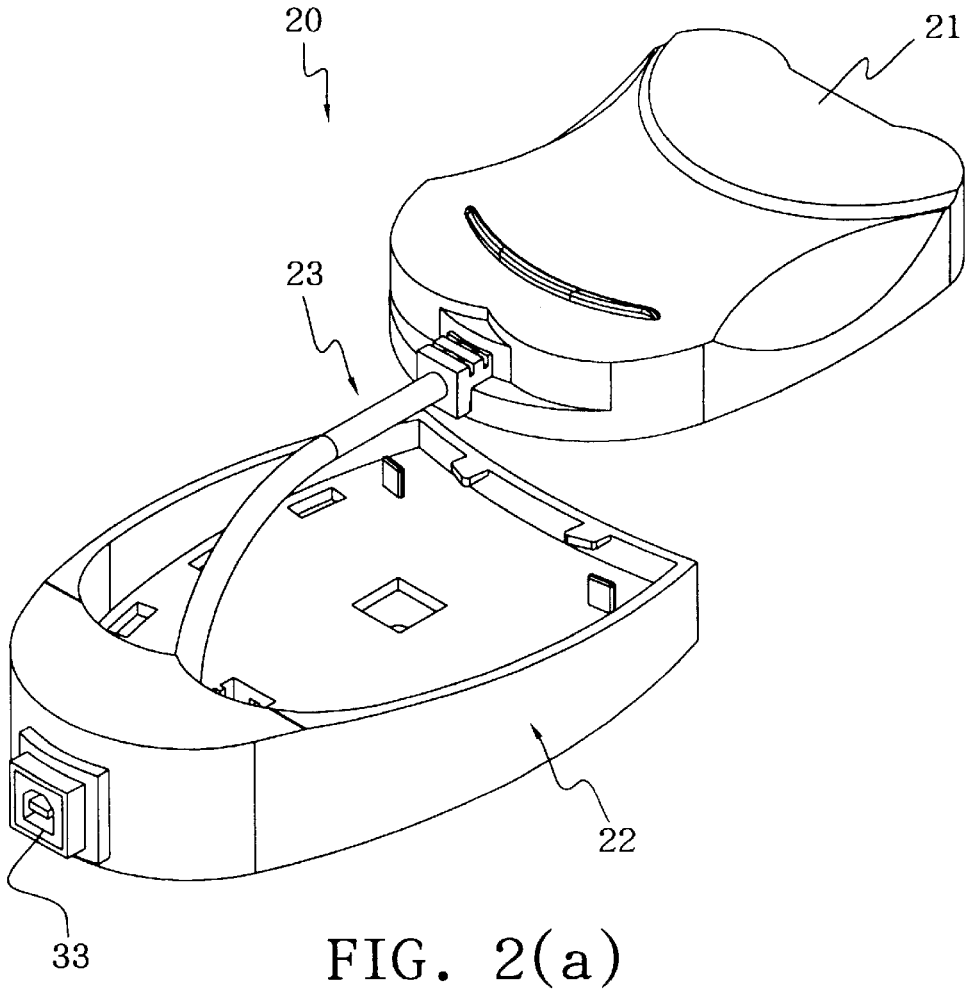
FIGS. 2(*a*) to 2(*b*) show the decomposition and combination diagrams of the USB network converters of the present invention.
Figure 2B:
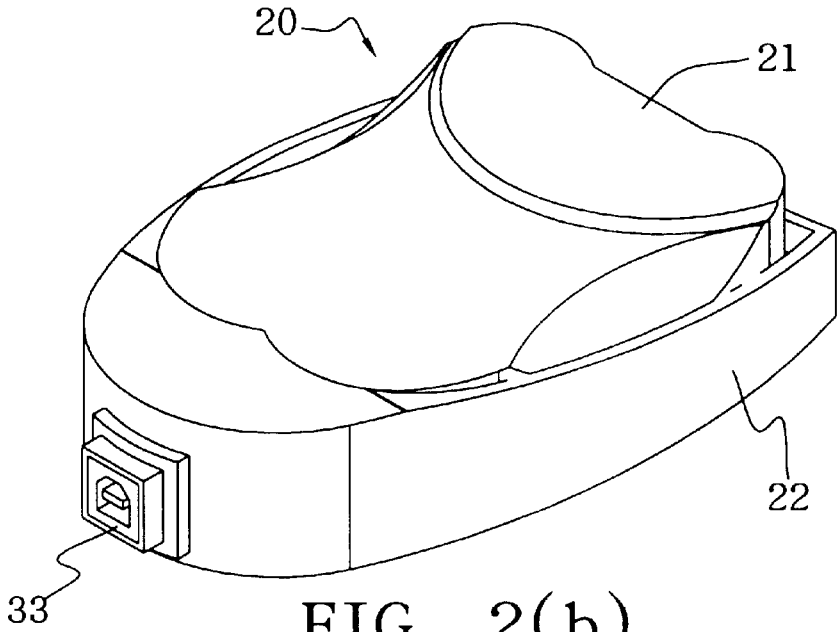

FIG. 2(*a*) to 2(*b*) shows the decomposition and combination diagrams of the USB network converter 20 of the present invention. The USB network converter 20 of the present invention comprises a converting body 21 and a base 22. The converting body 21 is generally similar to the USB network converter 10 shown in FIG. 1(*a*), including a USB cable 23 and a network port 37 on another side. Due to an expandable and modulable function, the USB network converter of the present invention can achieve the functions of the three prior USB network converters.

Figure 3A:
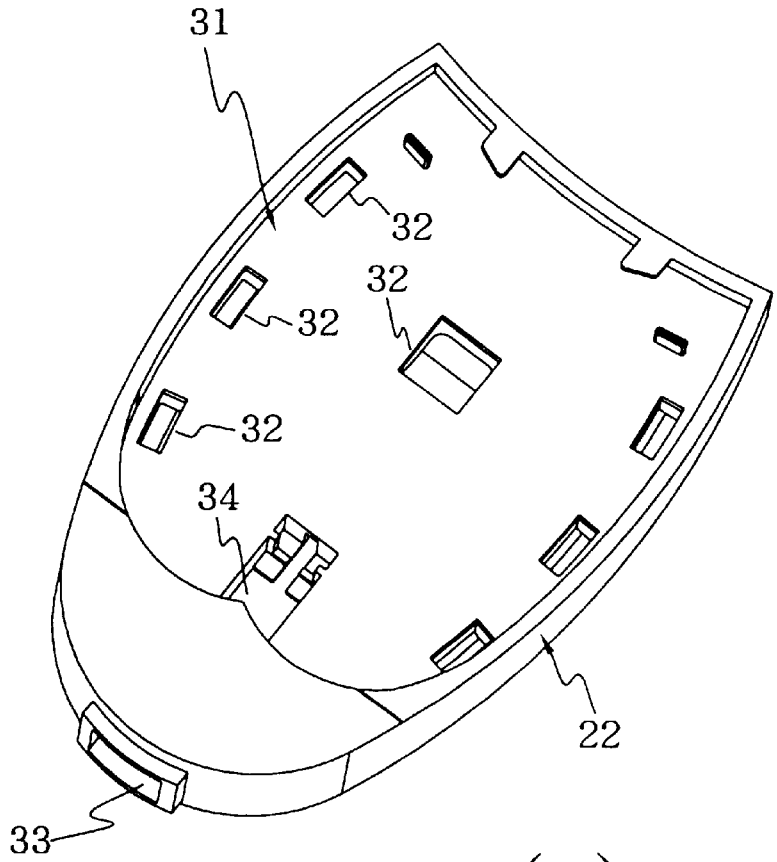
FIGS. 3(*a*) to 3(*b*) show the solid diagrams of the positive and reverse sides of the base of the USB network converter of the present invention.
Figure 3B:
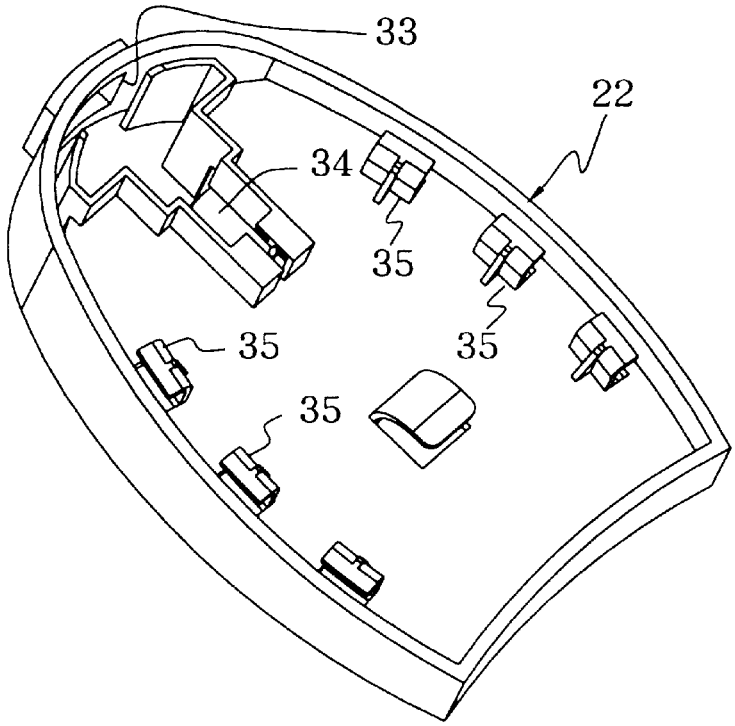

FIG. 3(*a*) shows the solid diagram of the positive side of the base 22 of the USB network converter 20 of the present invention. A containing portion 31 is in the rear of the positive side of the base 22 for containing the converting body 21 of the present invention, therefore the shape of the containing portion 31 will cooperate with the shape of the converting body 21. Besides, the containing portion 31 includes a plurality of coupling holes 32 (or a plurality of convex members) coupled to a plurality of convex members (not shown; or a plurality of coupling holes) for tightly combining the converting body 21 and the base 22. A socket hole 33 is in the front of the base 22 for leading the USB cable 23 of the converting body 21 to feed through or fix the USB plug on one end of the USB cable 23. There is a through hole 34 between the socket hole 33 and the containing portion 31 for penetrating the positive side and the reverse side of the base 22, and the USB cable 23 can feed through the through hole 34 from the positive side of the base 22 to the reverse side of the base 22.

Figure 4A:
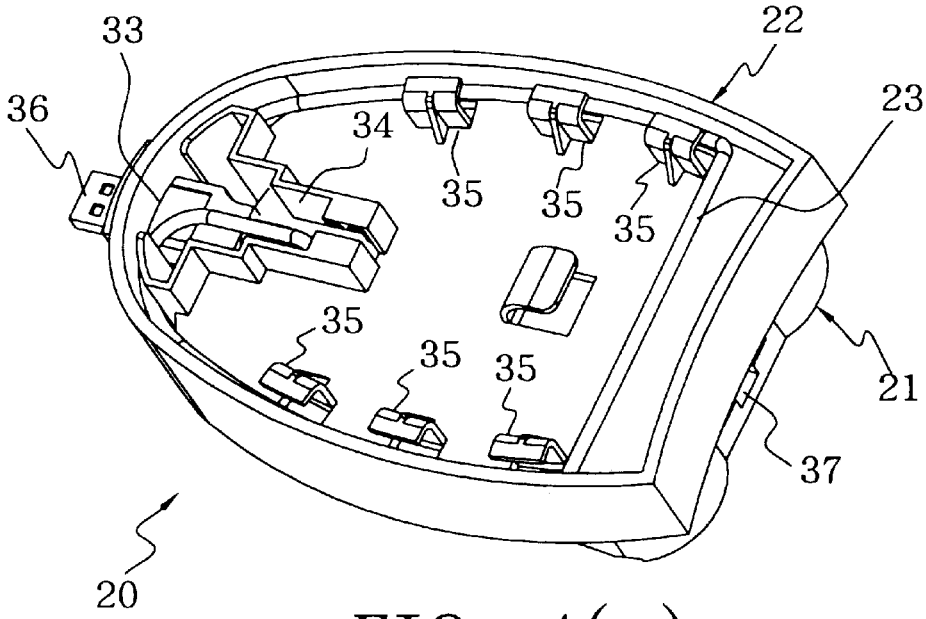
FIGS. 4(*a*) to 4(*b*) show the solid diagrams of the positive and reverse sides of the USB network converter of the present invention.
Figure 4B:
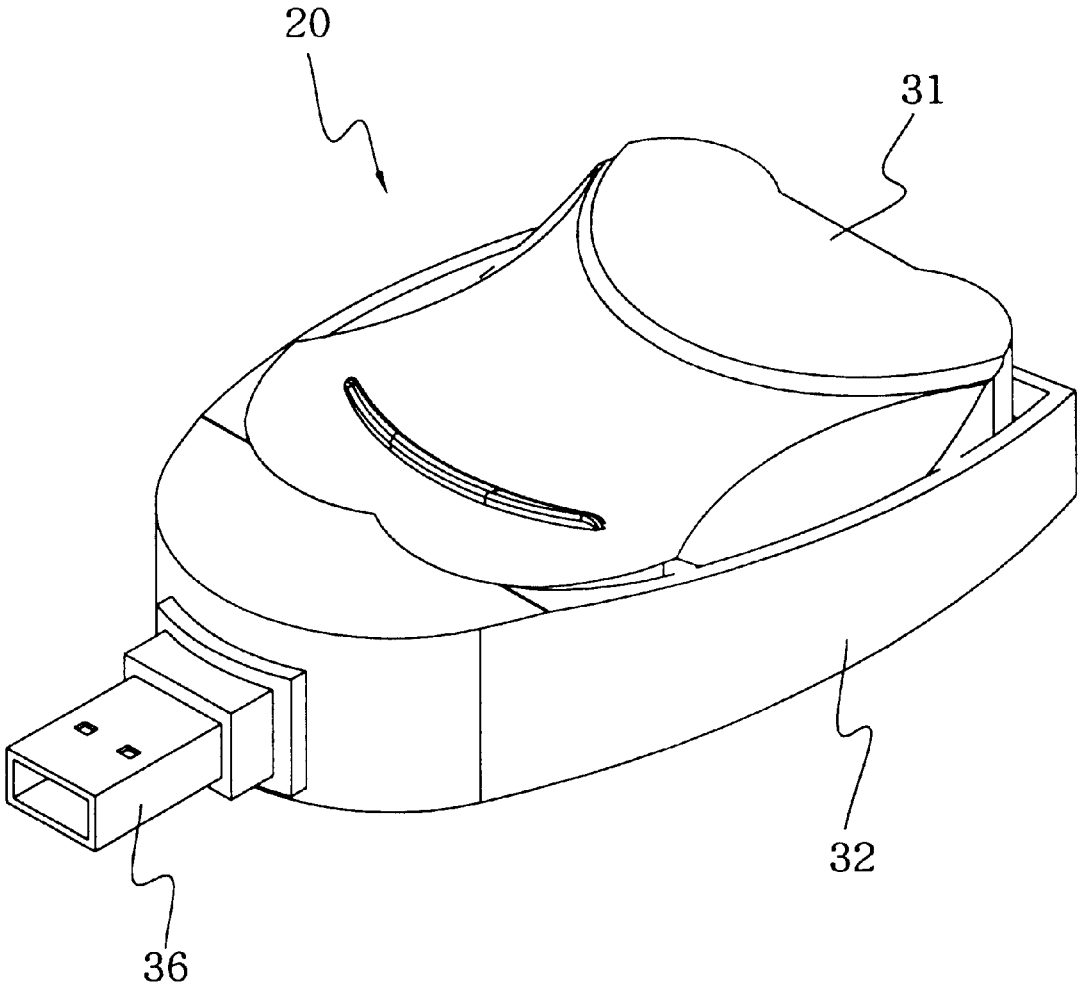

FIG. 3(*b*) shows the solid diagram of the reverse side of the base 22 of the USB network converter 20 of the present invention. There is a plurality of fastening members 35 in the inner circle of the reverse side of the base 22. When the USB cable 23 feeds through the through hole 34 from the positive side of the base 22 to the reverse side of the base 22, the USB cable 23 can either directly pass through the socket hole 33, as shown in FIG. 1(*a*), or wind the USB cable 23 by the plurality of fastening members 35 and only fastens the USB plug 36 of the USB cable 23 in the socket hole 33, as shown in FIG. 4(*a*). FIG. 4(*b*) is a positive side view of FIG. 4(*a*). When the USB cable 23 of the present invention is a A-typed USB cable, the structure is similar to a prior art shown as FIG. 1(*c*). When the USB cable 23 of the present invention is a B-typed USB cable, the structure is similar to a prior art shown as FIG. 1(*d*).

Another possible design rule is to move the fastening members 35 from the reverse side into the positive side, and users can either wind the USB cable 23 by the plurality of fastening members 35 on the positive side and fasten the USB plug 36 in the socket hole 33, or directly passes the USB cable 23 through the socket hole 33. The above structure has an advantage of omitting the through hole 34 between the positive and reverse sides, and also simplifying the design rule of the reverse side.

The above-described embodiments of the present invention are intended to be illustrative only. Numerous alternative embodiments may be devised by those skilled in the art without departing from the scope of the following claims.

What is claimed is:

1. A network converter applied in a USB, comprising:

a converting body including a USB cable with a USB plug; and a base for containing the converting body, the base including:

a containing portion on a positive side of the base for containing the converting body;

a through hole through the base for receiving the USB cable;

a socket hole on a front end of the base; and a plurality of fastening members on a reverse side of the base for fastening the USB cable and fixing the USB plug in the socket hole.

2. The network converter of claim 1, wherein the positive side of the base has means for tightly coupling with the converting body.

3. The network converter of claim 1, wherein the USB cable of the converting body belongs to type A or type B.

4. The network converter of claim 1, wherein the USB cable either directly passes through the socket hole, or is winded by the plurality of fastening members and places the USB plug in the socket hole.

5. A base of a network converter applied in a USB for containing a converting body having a USB cable and a network port, the base comprising:

a containing portion on a positive side of the base for containing the converting body;

a through hole through the base for receiving the USB cable;

a socket hole on a front end of the base; and a plurality of fastening members on a reverse side of the base for fastening the USB cable and fixing the USB plug in the socket hole.

6. The base of a network converter of claim 5, wherein the positive side has means for tightly coupling with the converting body.

7. The base of a network converter of claim 5, wherein the USB cable either directly passes through the socket hole, or is winded by the plurality of fastening members and places the USB plug in the socket hole.

* * * * *